United States Patent [19]

Hart et al.

[11] 4,227,521

[45] Oct. 14, 1980

[54] AIR SYSTEM FOR SCUBA DIVING

[75] Inventors: Dennis Hart, Hacienda Heights; Masaru Shiroishi, Buena Park, both of Calif.

[73] Assignee: Under Sea Industries, Inc., Compton, Calif.

[21] Appl. No.: 968,746

[22] Filed: Dec. 13, 1978

[51] Int. Cl.[3] ..... B63C 11/22

[52] U.S. Cl. ..... 128/202.14; 128/204.26

[58] Field of Search ..... 128/142.2, 142 R, 142.3, 128/142.4, 147, 202.14, 204.26; 9/342, 316, 319, 332; 405/185; 137/854, DIG. 9

[56] References Cited

U.S. PATENT DOCUMENTS

| | | | |
|---|---|---|---|
| 3,436,777 | 4/1969 | Greenwood | 9/342 |
| 3,874,378 | 4/1975 | Isaacson et al. | 128/145.8 |
| 3,973,588 | 8/1976 | Holst | 137/854 |
| 4,045,835 | 9/1977 | Flam et al. | 128/142.2 |
| 4,137,585 | 2/1979 | Wright | 9/342 |

*Primary Examiner*—Henry J. Recla
*Attorney, Agent, or Firm*—Flam & Flam

[57] ABSTRACT

A scuba diver uses air not only for breathing, but also to inflate a buoyancy jacket or vest. A single mechanism controls the flow of air for buoyancy and for breathing. The mechanism is held by a mouthpiece and includes (1) a demand regulator, (2) a breathing chamber between the regulator and the mouthpiece, (3) a pruge or one way exhaust valve connected to the breathing chamber, (4) a buoyancy chamber communicating with an inflation/deflation hose for the jacket or vest, (5) a first manual control valve for sending relatively high pressure air to the buoyancy chamber and (6) a second composite manual control valve that in its initial position opens the buoyancy chamber to the breathing chamber for exhaust of air through the purge valve and consequent deflation of the buoyancy jacket or vest, and that in its final position closes the purge valve for oral inflation or emergency breathing.

9 Claims, 6 Drawing Figures

AIR SYSTEM FOR SCUBA DIVING

FIELD OF INVENTION

This invention relates to scuba diving equipment, and particularly breathing apparatus including buoyancy stabilizers.

DISCUSSION OF PRIOR ART

It is now quite common for buoyancy jackets to be used in diving. Such jackets are commonly used in two modes: a compensator mode and an emergency mode. In the compensator mode, neutral or slight positive or negative buoyancy is provided to assist underwater maneuvers, in fact to make such maneuvers nearly effortless. In an emergency mode, the air supply tank and the breathing regulator are jettisoned for very positive buoyancy, causing the diver to surface rapidly. During such an ascent, the diver uses the air in the buoyancy jacket as a breathing source. For these purposes, an inflator tube is attached to the jacket that, at its distal end, carries (1) a mouthpiece, (2) a quick release fitting for detachable connection to the high pressure tank and (3) dump and fill valves. Such a device is shown and described in U.S. Pat. No. 3,727,250 to Koehn et al.

The problem is that the bulk and number of equipment is multiplied. Another problem is that the diver must discard his regulator mouthpiece and shift over to the mouthpiece of the inflator structure for emergency ascent. In so shifting, the auxiliary mouthpiece must be located and purged of water. In an emergency situation, valuable time may be lost. Moreover, if the inflator mouthpiece is not immediately obtained, anxiety may cause time to be lost. Ideally, the user should not be required to change mouthpieces at all so that (1) nothing need be purged, (2) the diver has no cause to panic and (3) shifting to the emergency mode requires very minimal, easily learned manipulations.

OBJECTIVES

The primary object of the present invention is to provide an integrated breathing system in which the diver is not required to shift mouthpieces to change from the normal breathing mode utilizing a tank of compressed air to the emergency mode in which the buoyancy jacket or vest is used as the source of breathing air, such as for a rapid surfacing operation. A companion object of the present invention is to minimize the amount of equipment required to be carried by a scuba diver. Still another object of the present invention is to provide a breathing system for scuba diving having an exhaust mechanism compatible both with the conventional demand breathing mode of a composite system and the emergency mode in which the buoyancy bag is used as a source of breathable gases.

SUMMARY OF INVENTION

In order to accomplish the foregoing objectives, we provide a composite regulator body. The body houses a conventional demand regulator to supply breathable gases to a regulator or breathing chamber and a mouthpiece connected thereto. The body has a fitting that, via a manually operable valve, connects the breathing chamber to the buoyancy bag. The valve is opened upon initial movement of a push button actuator whereby the bag can be deflated by movement of air through the exhaust valve. Subsequent movement of the actuator closes the exhaust valve whereby communication between the mouthpiece and the buoyancy bag is provided that is free of unintended leakage past the exhaust valve.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

Figure 1:
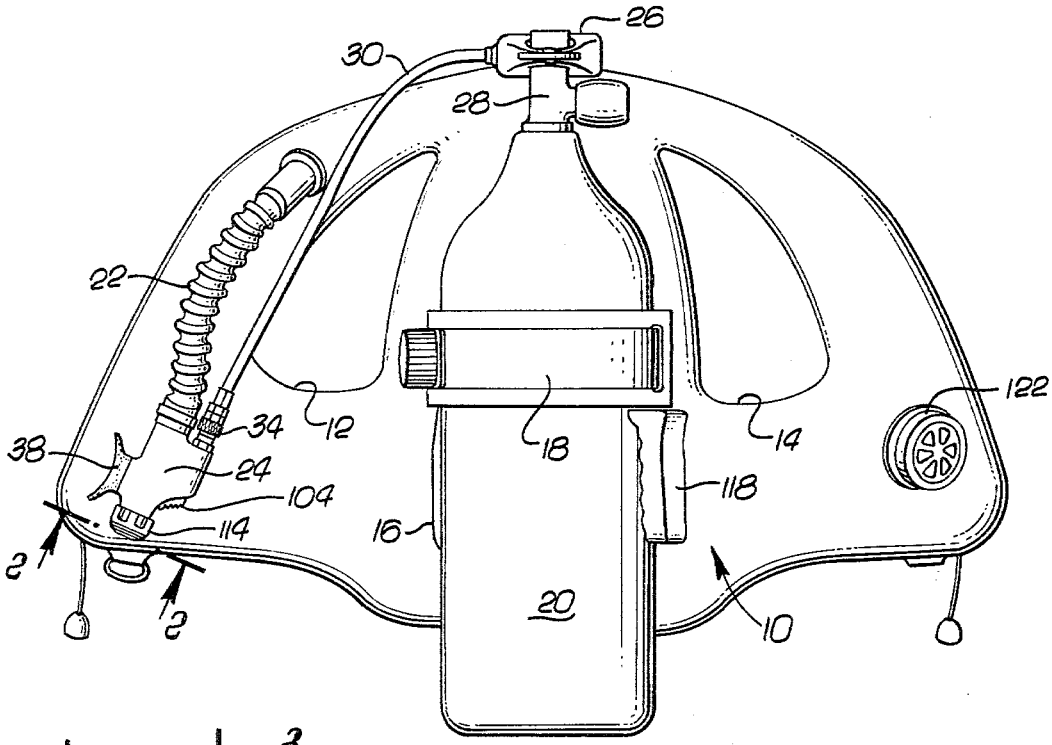
FIG. 1 is a plan view of a breathing and buoyancy system for scuba diving, including a buoyancy jacket, a tank of compressed air and a breathing regulator.

The following detailed description is of the best presently contemplated mode of carrying out the invention. This description is not to be taken in a limiting sense, but is made merely for purposes of illustrating the general principles of the invention since the scope of the invention is best defined by the appended claims.

A buoyancy bag 10 in the form of a jacket has arm holes 12 and 14. Attached to the jacket is a rigid back pack 16 that includes a band 18 for releasably clamping a tank 20 to the pack. The tank 20 contains air under high pressure.

The jacket is inflatable through a large diameter flexible hose 22, one end of which is fitted to the jacket 10, and the other end of which is attached to a regulator body 24. The proximal end of the hose is located adjacent the left shoulder region in front of the arm hole 12.

For normal operation, air from the high pressure tank 20 is conducted to the regulator body 24 for use by the diver as he demands it. For this purpose, a conventional first stage regulator 26 is detachably connected, as by a yoke and screw device, to a high pressure valve 28 inserted into the neck of the tank 20. The first stage regulator 26 delivers air to flexible high pressure line 30 at about 125 or 140 p.s.i. above ambient, all in a well understood manner.

Figure 4:
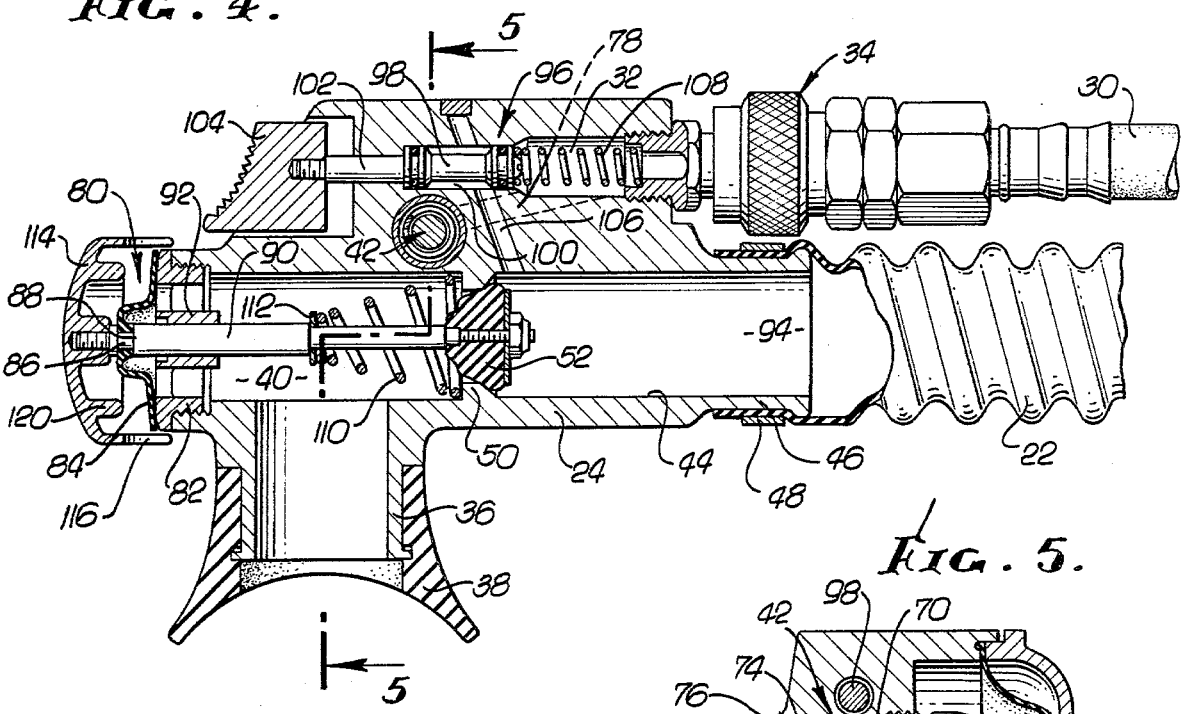
FIG. 4 is a horizontal sectional view of the regulator taken along a plane corresponding to line 4—4 of FIG. 2.

The high pressure line 30 connects to a small inlet (FIG. 4) on the back of the regulator body 24 by the aid of a quick disconnect coupling 34 of a type such as shown and described in U.S. Pat. No. 3,747,140 to Roberts. On the front of the regulator body 24 opposite the inlet chamber 32 is a nipple 36 to which a mouthpiece 38 is fitted. Air from the inlet chamber 32 is conducted to a breathing chamber 40 via a demand valve 42 that opens in response to lowering of pressure in the breathing chamber 40 as by inhalation.

The breathing chamber 40 is formed at one end of a generally cylindrical bore or passage 44. The bore or passage 44 extends from side to side entirely through the central portion of the body 24. The other end of the bore or passage 44 forms a buoyancy chamber 94 that is continuously in communication with the jacket 10. The outer end of the buoyancy chamber 94 is surrounded by a nipple 46 that provides attachment of the jacket hose 22, as by a clamp 48. The opposite ends of the bore or passage 44 are separated by an internal flange 50 and a closure 52 in the buoyancy chamber. The operation of the closure 52 will be described more fully hereinafter.

Figure 2:
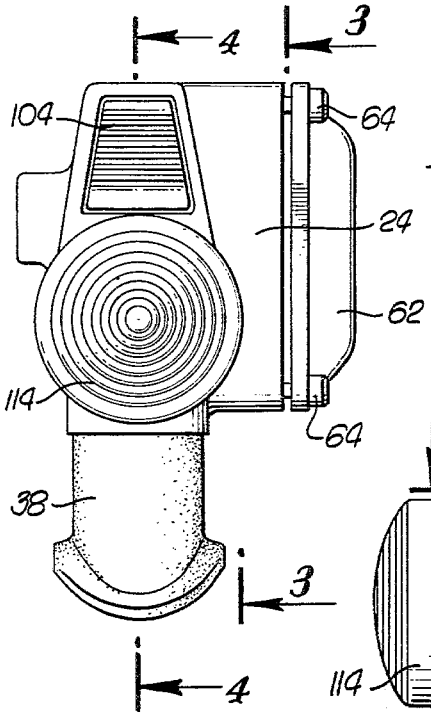
FIG. 2 is an enlarged side elevational view of the regulator body.
Figure 3:
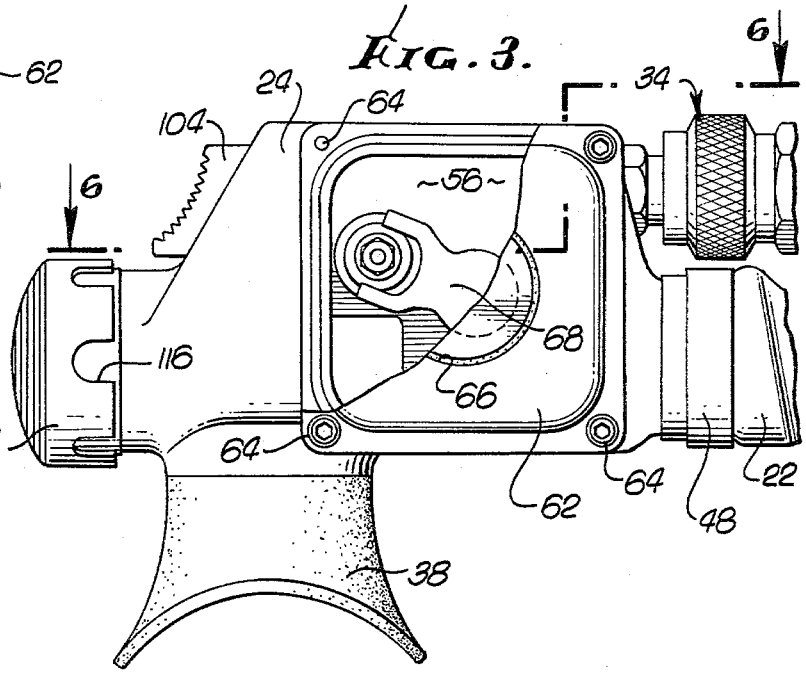
FIG. 3 is a plan view of the regulator, a portion of the apparatus being broken away along the plane indicated by line 3—3 of FIG. 2.
Figure 5:
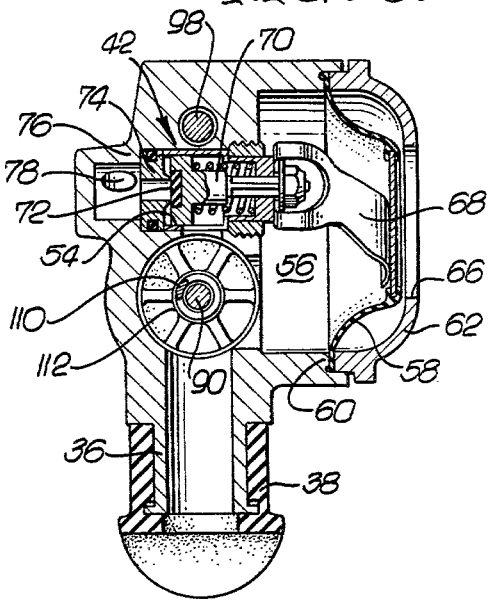
FIG. 5 is a sectional view taken along the offset plane corresponding to line 5—5 of FIG. 4.
Figure 6:
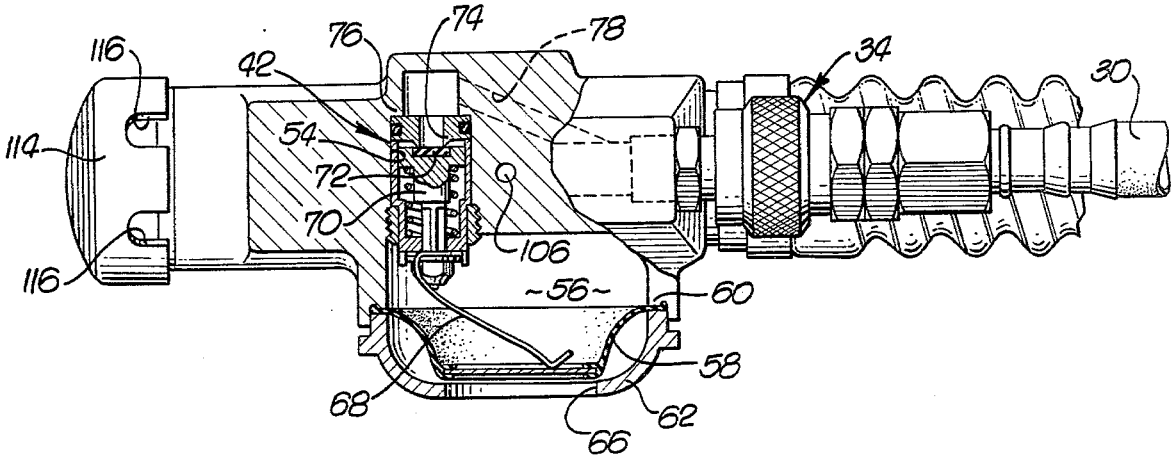
FIG. 6 is a view, partly in section, taken along the offset plane corresponding to line 6—6 of FIG. 3.

As shown in FIGS. 5 and 6, the demand valve 42 is accommodated in a small diameter cylindrical bore 54 eccentrically located in the bottom of a shallow regulator recess 56. The regulator recess 56 is formed on the under side of the regulator body 24. A flexible sensing diaphragm 58 is peripherally clamped to a shoulder 60 formed about the edges of the recess 56. For this purpose, a cover plate 62 is provided that is fastened in place by four cap screws 64 (FIGS. 2 and 3). The cover plate 62 has a central opening 66 that exposes the diaphragm to ambient pressure.

Instead of locating the regulator recess 56 on the underside of the body 24, it can be moved to the top simply by changing the way that the mouthpiece is held in the diver's mouth. In fact, such orientation may better assist purging unwanted water from the unit. To minimize excessive twisting of hoses with the recess 56 uppermost, the mouthpiece nipple 36 is desirably moved from the front to a position adjacent to, but offset from, the inlet chamber 32.

The regulator recess 56 freely communicates with the breathing chamber 40 as shown in FIG. 5. When the diver inhales through the mouthpiece 38, the pressure in the regulator chamber 56 reduces, causing the diaphragm to move inwardly. Such inward movement opens the demand valve 42. This is achieved by a lever 68 connected to a valve stem 70. The inner end of the valve stem 70 carries a resilient closure 72 that cooperates with a valve seat insert 74. The insert 74 rests on an intermediate shoulder 76 near the bottom of the valve recess 54. A lateral bore 78 at the bottom of the recess (FIGS. 4, 5 and 6) conducts air from the main inlet chamber 32 to the insert 74 for passage into the breathing chamber when the closure 70 is lifted away.

Used air that is exhaled back through the mouthpiece 38 re-enters the breathing chamber 40 and exits through an exhaust valve 80. The exhaust valve 80 is located at the side of the body 24 at the outer end of the breathing chamber 40. The exhaust valve 80 comprises two parts. One part is a ported seat member 82 (FIG. 4) screw threaded into the lateral opening of the breathing chamber 40. The second part of the exhaust valve 80 is a generally circular flexible flap closure 84 on the outside of the seat member 82. The closure overlies the ports of the seat member 82 annularly to engage the seat member rim. The flap closure 84 has a central hub 86 mounted in a groove 88 of a valve stem 90. The valve stem 90 is guided in an elongated central hub 92 of the hollow seat member 82 for longitudinal movement. Exhaust air passes outwardly through the hollow seat member 82 and radially outwardly between the flap valve 84 and the rim of the seat member 82.

In order to adjust buoyancy, air is supplied to or released from the buoyancy jacket 10. Air from the supply hose 30 is conducted to the buoyancy chamber 94 by a valve 96. The valve 96 is located at the bottom of the inlet chamber 32. The valve structure 96 in the present instance includes a spool 98 slidable in a bore 100. A stem 102 attached to the spool 98 extends to the outside of the body for attachment of an actuator button 104.

When the button 104 is pushed inwardly, as by digital pressure, the spool 98 unseats to open the bottom of the inlet chamber 32 to a lateral passage 106 that leads to the compensator end 94 of the bore 44. A coiled spring 108 in the inlet chamber 32 yieldingly resists such movement and returns the spool 98 to its normal closed position.

The exhaust valve 80 is used to deflate the buoyancy jacket 10. For this purpose, the buoyancy conduit 94 is placed in communication with the breathing chamber 40 by moving the valve closure 52 away from its seat. A conical spring 110 surrounds the stem 90, its large end being seated on the breathing chamber side of the flange 50 and its small end engaging a stop ring 112 on the stem. The spring 110 holds the closure member 52 seated.

In order to unseat the closure member 52, an actuator button 114 is attached to the end of the stem 90 that projects beyond the diaphragm case 24. The button 114 overlies and thus shields the flap valve 82. The button 114 has a skirt that partially telescopes over the seat member 82. The skirt has openings 116 to ensure free passage of exhaust air when the flap valve 84 opens.

Inflation and deflation of the buoyancy bag 10 takes place simply by engagement of one of the actuators 104 or the other 114. The diver soon learns to associate the buttons with their corresponding functions. The case 24 is always in a fixed position relative to the body of the diver. Hence, no groping is required to find the actuators 104 and 114.

In the event that it becomes urgently necessary to surface, the diver need not discard his mouthpiece to find another dangling from the breathing bag. He merely manipulates the quick disconnect mechanism 34 after first filling the bag 10 to a usable or required level. He then pulls the release handle 118 of the back pack 16, jettisoning the tank 20. Air can be sucked from the bag 10 for breathing. To do this, the actuator 114 is pushed all the way down, thereby positively closing the exhaust valve 80. Closure is accomplished by an internal flange 120 (FIG. 4) that clamps the flap valve 84 to the annular rim of the seat member 82. The precious air supply is thereby contained. To exhale, the actuator 114 is fully released, allowing used air to be purged from the system while the bag is isolated from the used air.

A simple, safe and compact breathing apparatus is provided having all of the operational features of past systems.

The jacket or breathing bag 10 is provided with the usual accessories, including a relief valve 122 to prevent overinflation. Pressurized air cartridges (not shown) can also be carried by the jacket for inflation by this alternate mode.

Intending to claim all novel, useful and unobvious features shown or described, we make the following claims:

1. In a breathing system for scuba diving:

(a) a buoyancy bag in the form of an inflatable jacket or the like;

(b) a hose connected at one end to the bag for inflation and deflation thereof;

(c) a high pressure line for conducting breathable air from a supply tank;

(d) a regulator body providing an inlet chamber connected to said high pressure line, a breathing chamber, and a buoyancy conduit connected to the other end of said hose said breathing chamber being defined in part by a movable wall closing an opening of the body;

(e) a mouthpiece uninterruptedly connected to said breathing chamber;

(f) conduit means in said regulator body connecting said inlet chamber to said breathing chamber to supply air to said breathing chamber;

(g) demand valve means including a link connected to said movable wall and a movable valve part in said conduit means connected to said link and operative to open and close said conduit means in accordance with the position of said movable wall in order to supply breathable gas in accordance with the demands of the diver;

(h) first valve means selectively connecting said inlet chamber to said buoyancy conduit, and including a first manual actuator mounted on said regulator body and spring means biasing said first valve means to close;

(i) second valve means selectively movable to an open position for providing an unrestricted bidirectional flow connection between said mouthpiece and said buoyancy conduit via said breathing chamber, and including a second manual actuator mounted on said regulator body, and spring means biasing said second valve means to close;

(j) an exhaust valve connecting said breathing chamber to atmosphere; and (k) means closing said exhaust valve while said second valve means is open to provide a direct breathing path between said buoyancy conduit and said mouthpiece.

2. The breathing system as set forth in claim 1 in which said second manual actuator is located at said exhaust valve, and includes said closing means which is operative only after an initial motion of said second manual actuator so that, in an intermediate position, said buoyancy conduit is provided with an exhaust path via said breathing chamber.

3. The combination as set forth in claim 1 together with quick disconnect means forming a serial part of said high pressure line and located adjacent said regulator body.

4. The breathing system as set forth in claim 1 in which said second manual actuator is located at said exhaust valve, and includes said closing means which is operative only after an initial motion of said second manual actuator so that, in an intermediate position, said buoyancy conduit is provided with an exhaust path via said breathing chamber; and quick disconnect means for the high pressure line.

5. The combination as set forth in claim 1 in which said manual actuators are located adjacent each other on the same side of the body for alternate manual operation by the diver.

6. The combination as set forth in claim 1 in which said buoyancy conduit and said breathing chamber are adjacent and separated only by said second valve means, said second valve means including a valve stem extending through said breathing chamber and outwardly through said exhaust valve, said closing means comprising a button attached to the end of said stem and having a circular part normally spaced from said exhaust valve, but movable into clamping engagement therewith upon movement of said button in a direction to open said second valve means.

7. In a breathing regulator:

(a) a regulator body having a breathing chamber, a buoyancy conduit and an inlet chamber, said buoyancy conduit being cooperable with an inflation/deflation hose of a buoyancy jacket or the like, said inlet chamber being cooperable with a high pressure supply of breathable gas; there being conduit means between said breathing chamber and said inlet chamber;

(b) a mouthpiece uninterruptedly connected to said breathing chamber;

(c) demand valve means connecting said inlet chamber to said breathing chamber to supply air to said breathing chamber in accordance with the demands of the diver, said demand valve means including a wall in part defining said breathing chamber and movable in accordance with the difference in pressure between the breathing chamber and the ambient, a link connected to the wall, and a movable valve part in said conduit means and operated by said link to open and close said conduit means;

(d) first valve means selectively connecting said inlet chamber to said buoyancy conduit, and including a first manual actuator mounted on said regulator body and spring means biasing said first valve means to close;

(e) second valve means selectively movable to an open position for providing an uninterrupted bidirectional flow connection between said mouthpiece and said buoyancy conduit via said breathing chamber and including a second manual actuator mounted on said regulator body, and spring means biasing said second valve means to close;

(f) an exhaust valve connected to said breathing chamber;

(g) means closing said exhaust valve while said second valve means is open to provide a direct breathing path between said buoyancy conduit and said mouthpiece.

8. In a breathing regulator:

(a) a regulator body having a breathing chamber, a buoyancy conduit and an inlet chamber, said buoyancy conduit being cooperable with an inflation/deflation hose of a buoyancy jacket or the like, said inlet chamber being cooperable with a high pressure supply of breathable gas; there being conduit means between said breathing chamber and said inlet chamber;

(b) a mouthpiece uninterruptedly connected to said breathing chamber;

(c) demand valve means connecting said inlet chamber to said breathing chamber to supply air to said breathing chamber in accordance with the demands of the diver, said demand valve means including a wall in part defining said breathing chamber and movable in accordance with the difference in pressure between the breathing chamber and the ambient, a link connected to the wall, and a movable valve part in said conduit means and operated by said link to open and close said conduit means;

(d) first valve means selectively connecting said inlet chamber to said buoyancy conduit, and including a first manual actuator mounted on said regulator body and spring means biasing said first valve means to close;

(e) second valve means selectively movable to an open position for providing an uninterrupted bidirectional flow connection between said mouthpiece and said buoyancy conduit via said breathing chamber including spring means biasing said second valve means to close;

(f) an exhaust valve connected to said breathing chamber opposite said second valve means, and including a flexible flap closure;

(g) a stem having a first end extending through said flap closure and a second end connected to said second valve means for moving said second valve means to an open position;

(h) a second actuator attached to the first end of said stem; and (i) clamp means carried by the first end of said stem to clamp said flap closure in closed position only after said second valve means has been opened thereby to provide a direct breathing path between said buoyancy conduit and said mouthpiece unaffected by said exhaust valve.

9. The combination as set forth in claim 8 in which said manual actuators are located adjacent each other for alternate operation by the diver.

* * * * *